US005798986A

United States Patent [19]

Tzeng

[11] Patent Number: 5,798,986

[45] Date of Patent: Aug. 25, 1998

[54] ALARM MECHANISM SYSTEM

[75] Inventor: Jaw-Horng Tzeng, Fengshan, Taiwan

[73] Assignee: Industrial Technology Research Institute, Hsinchu, Taiwan

[21] Appl. No.: 739,071

[22] Filed: Oct. 28, 1996

[51] Int. Cl.[6] ..... G04C 21/16

[52] U.S. Cl. ..... 368/74; 368/252

[58] Field of Search ..... 368/72–74, 243–244, 368/250, 252, 254

[56] References Cited

U.S. PATENT DOCUMENTS

| | | | |
|---|---|---|---|
| 3,611,702 | 10/1971 | Spadini | 368/252 |
| 4,000,384 | 12/1976 | Kumazawa | 200/37 R |
| 4,199,390 | 4/1980 | Lebet et al. | 368/252 |
| 4,214,134 | 7/1980 | Ogihara et al. | 200/37 R |
| 4,465,381 | 8/1984 | Cleusix | 368/250 |
| 4,922,475 | 5/1990 | Scholer | 368/252 |

*Primary Examiner*—Vit W. Miska
*Attorney, Agent, or Firm*—W. Wayne Liauh

[57] ABSTRACT

An alarm mechanism system, comprising: an hour wheel, completing one turn every 12 hours; a ring gear, concentrically surrounding the hour wheel; a planet gear device, engaging with the hour wheel and the ring gear and, driven by the hour wheel, completing one turn every 24 hours; an alarm device, which contacts the planet gear device at a predetermined time within one turn of the planet gear device and issues an alarm at that time; and an adjustment device to adjust the predetermined time. The planet gear device completes a turn in 24 hours, enabling the alarm device to issue an alarm once in 24 hours.

4 Claims, 6 Drawing Sheets

ALARM MECHANISM SYSTEM

BACKGROUND OF THE INVENTION

1. Field of the Invention

The present invention relates to an alarm mechanism system, particularly to an alarm mechanism inside a table-top clock or inside a wristwatch.

2. Description of Related Art

Alarm mechanism systems in conventional quartz or electronic clocks fall into two types. In the first, a cam-like wheel is mounted on a common shaft with the hour hand, turning along with the hour hand. On the preset time, it touches a trigger plate, closing an electrical switch, such that an alarm is given. This alarm mechanism system is simple and easily assembled. A drawback, however, is its demand for space, allowing for installation in table-top alarm clocks only, not in wristwatches. Furthermore, the time precision of such a device is not better than 5–15 minutes.

In the second type of conventional alarm mechanism systems, a conducting disc is mounted on a common shaft with the hour hand, staying in contact with a conducting plate. The surface of the conducting disk is covered with an electrically insulating layer, except a small angle, which is left uncovered. When the hour hand, while turning, reaches the predetermined position, the noninsulated sector of the conducting disc is in contact with the conducting plate, and an alarm is issued. This alarm mechanism system occupies only a small volume and can therefore be built into wristwatches. Its time precision is about 5 minutes. However, assembling the components is complicated. Furthermore, the insulating layer gets worn after long use, causing malfunction of the alarm mechanism.

A disadvantage of both types is that the cam-like wheel and the conducting disc move along with the hour hand, reaching the preset time for issuing an alarm every 12 hours. A change of the time cycle to 24 hours requires additional components.

Further display functions, like day and night or date can be implemented only in a complicated way.

SUMMARY OF THE INVENTION

The main object of the present invention is to provide an alarm mechanism system with a time cycle of 24 hours.

Another object of the present invention is to provide an alarm mechanism system of simple design and easy assembly.

Another object of the present invention is to provide an alarm mechanism system of good precision, where additional functions, like display of day and night as well as display of the date can be easily implemented.

The present invention can be more fully understood by reference to the following description and accompanying drawings, which form an integral part of this application.

DETAILED DESCRIPTION OF THE PREFERRED EMBODIMENT

Referring to all figs., the alarm mechanism system of the present invention mainly employs a planet gear device with a time cycle of 24 hours together with an alarm trigger device. Since the time cycle of the planet gear device is 24 hours, the alarm cycle is extended to 24 hours. Furthermore, the change of day and night are directly displayed, and the display of dates is simplified.

Figure 1:
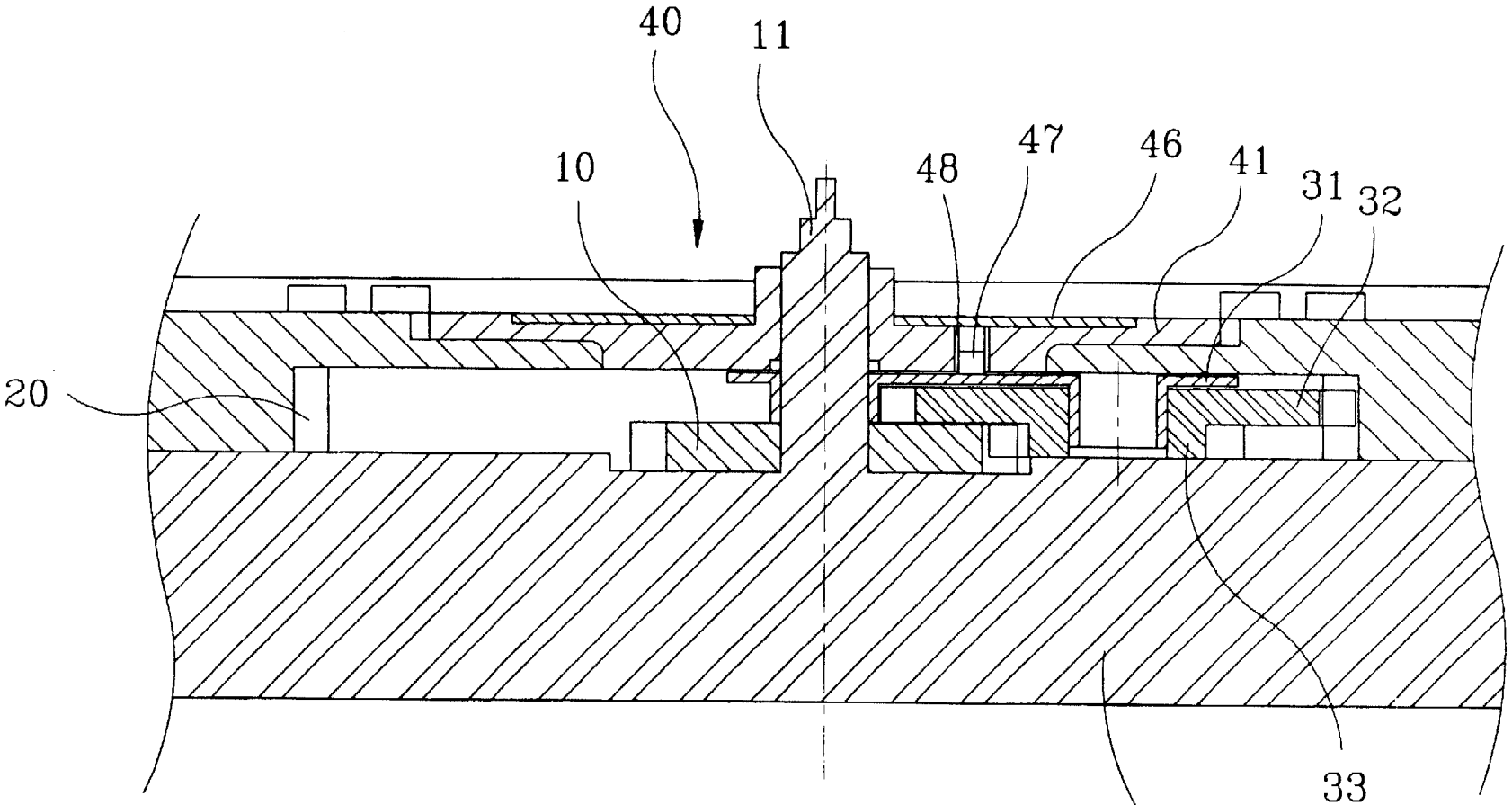
FIG. 1 is a sectional view of the alarm mechanism system of the present invention.
Figure 2:
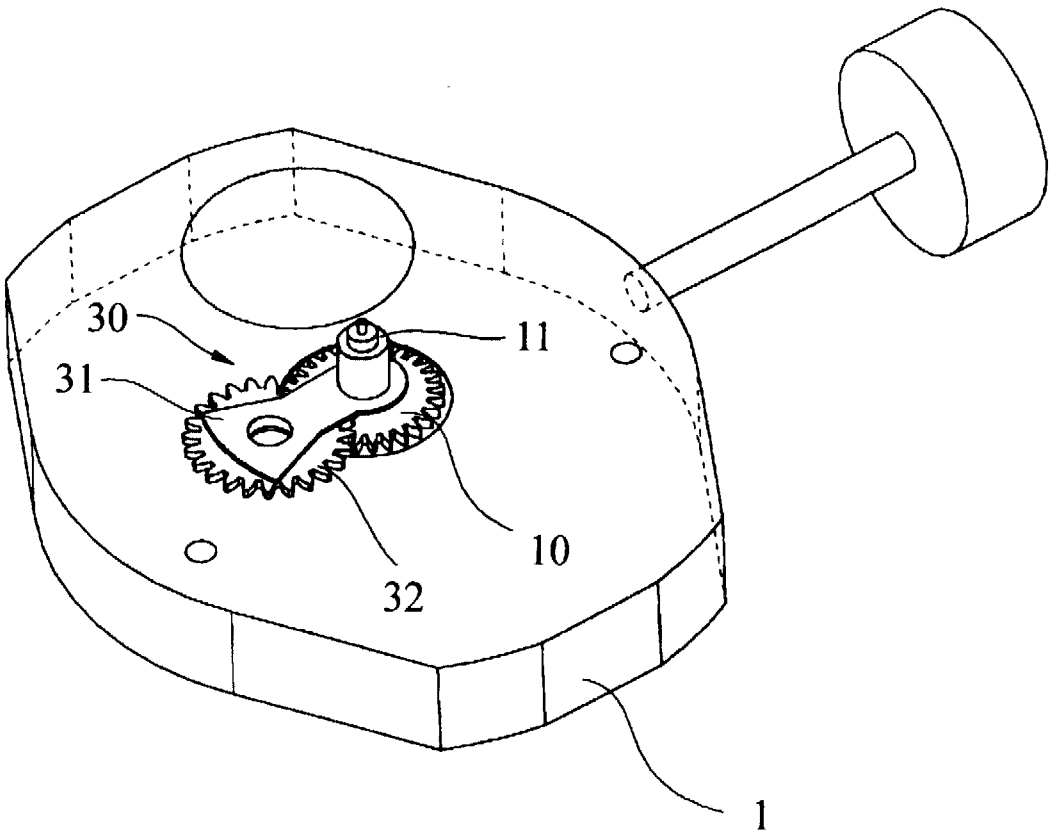
FIG. 2 is a perspective view, showing the planet gear device of the present invention.
Figure 3:
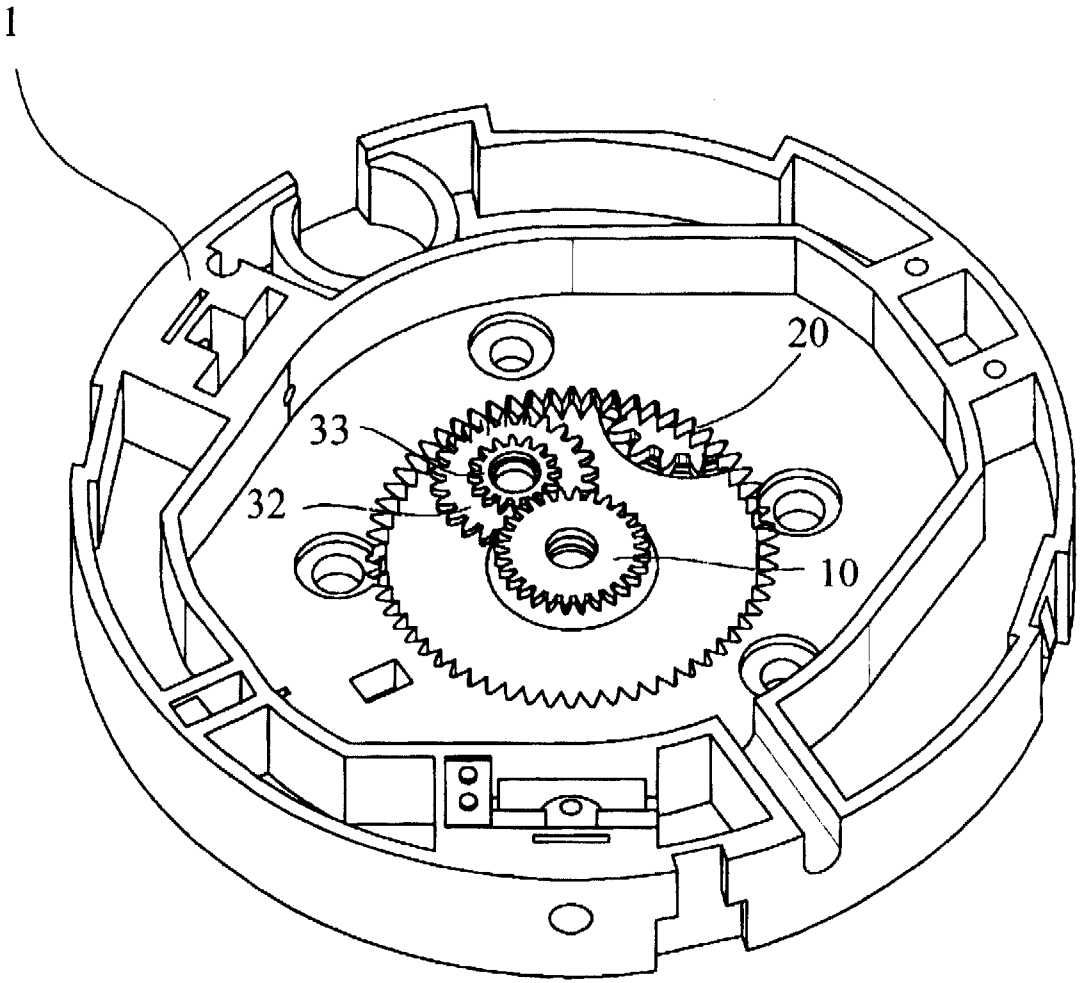
FIG. 3 is a perspective view, showing the planet gear device of the present invention as viewed from the other side.

Referring to FIG. 1 and 3, the alarm mechanism system of the present invention mainly comprises: a main body 1 with an hour wheel 10 and an hour hand shaft 11, turning along with the hour wheel 10; a ring gear 20, concentrically surrounding the hour wheel 10; and a planet gear device 30. The planet gear device 30 has a planet carrier 31, which surrounds the hour hand shaft 11, rotating around the hour hand shaft 11. On the outer end of the planet carrier 31 a first planet gear 32, which engages with the ring gear 20, and a second planet gear 33, which engages with the hour wheel 10, are mounted. The first and second planet gears 32 and 33 have a common axis and rotate simultaneously. When the hour wheel 10 turns, the first and second planet gears 32 and 33 rotate and, while rotating, revolve around the hour hand shaft, driving the planet carrier 31 around the axis of the hour hand shaft 11.

The number of teeth of the first and second planet gears 32 and 33, the hour wheel 10 and the ring gear 20 are chosen suitably, such that the rotational velocity of the planet gear device 30 and of the hour wheel 10 have a ratio of 1:2. Therefore, when the hour hand has completed two turns, the planet carrier 30 has completed one turn, and the time cycle of 12 hours of the hour wheel 10 is transformed into a time cycle of 24 hours of the planet carrier 30.

Since it is impossible to attain the desired rotational velocity ratio of 1:2 using only one planet gear, the present invention employs a planet gear comprising two coaxial planet gears with a different number of teeth, one planet gear engaging with the hour wheel 10 and one with the ring gear 20. Thus the desired ratio of the rotational velocity of the planet gear device 30 and of the hour wheel 10 of 1:2 is attained. The required number of teeth of the first and second planet gears 32 and 33, the hour wheel 10 and the ring gear 20 are known art and is not discussed here.

Figure 4:
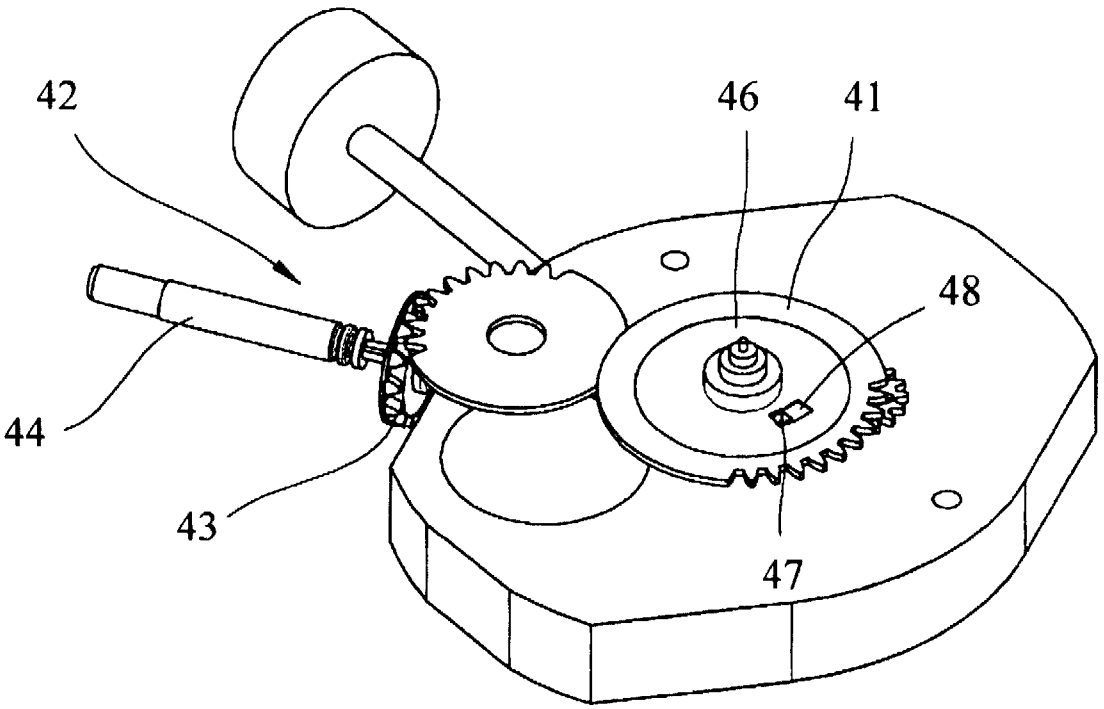
FIG. 4 is a perspective view, showing the alarm wheel device of the present invention.

The alarm mechanism system of the present invention in addition comprises an alarm device 40 in a position that is suitable to the planet gear device 30, which at the time preset by the user contacts an alarm circuit. As shown in FIGS. 1 and 4, the alarm device 40 comprises a alarm wheel 41, surrounding the hour hand shaft 11, and an adjustment device 42. The adjustment device 42 further comprises an adjustment wheel set 43, engaging with the alarm wheel 41 and driving the rotation of the alarm wheel 41, and a shaft 44, which is connected to the adjustment wheel set 43 and extends to the outside of the main body 1. By turning the shaft 44 the user adjusts the angular position of the alarm wheel 41.

Figure 5:
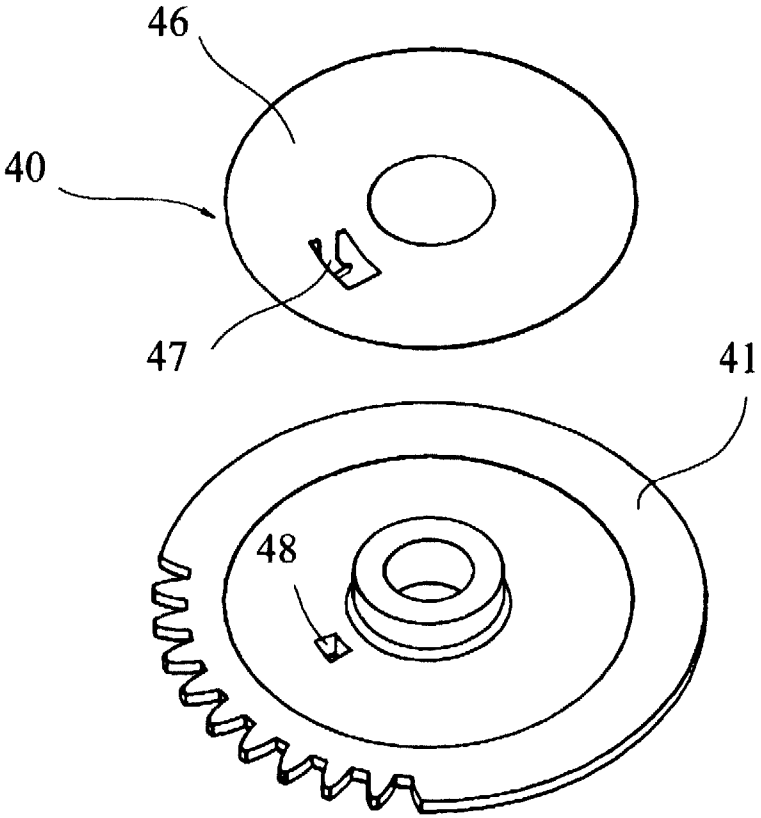
FIG. 5 is a perspective view, showing the alarm wheel and the alarm trigger disc of the present invention.

As shown in FIG. 5, an alarm trigger disc 46 is attached to one side of the alarm wheel 41. The alarm trigger disc 46 has an electrical contact strip 47 extending downwards. The electrical contact strip 47 extends through a hole 48 in the alarm wheel 41 to the level of the planet carrier 31.

Both the planet carrier 31 and the alarm trigger wheel 46 are made of electrically conducting material. They form part of an alarm circuit. When the planet carrier 31 and the alarm trigger wheel 46 contact each other, the circuit is closed, and an alarm is issued.

Setting the alarm time of the alarm mechanism system of the present invention is done by turning the shaft 44, thereby driving the adjustment wheel set 43 and bringing the alarm wheel 41 into a certain angular position that corresponds to the alarm time. Accordingly, the contact strip 47 of the alarm trigger disc 46 is brought into a certain angular position. When the hour hand reaches the time, as determined by the alarm device 40, the planet carrier 31 in its rotating movement reaches the same angular position as the contact strip 47, and an alarm is triggered.

The special characteristic of the present invention lies in employing the planet gear device 30 and the alarm device 40 suitably to each other. So there is no need for an additional mechanism to change the alarm time cycle to 24 hours. The present invention uses only few structural elements, which occupy a small volume and save space. Moreover, the precision of the alarm wheel device is high, within the range of 5 minutes.

Since the time cycle of the present invention is 24 hours, other display devices, like for displaying day and night or date, can be directly mounted on the planet gear device 30.

Figure 6:
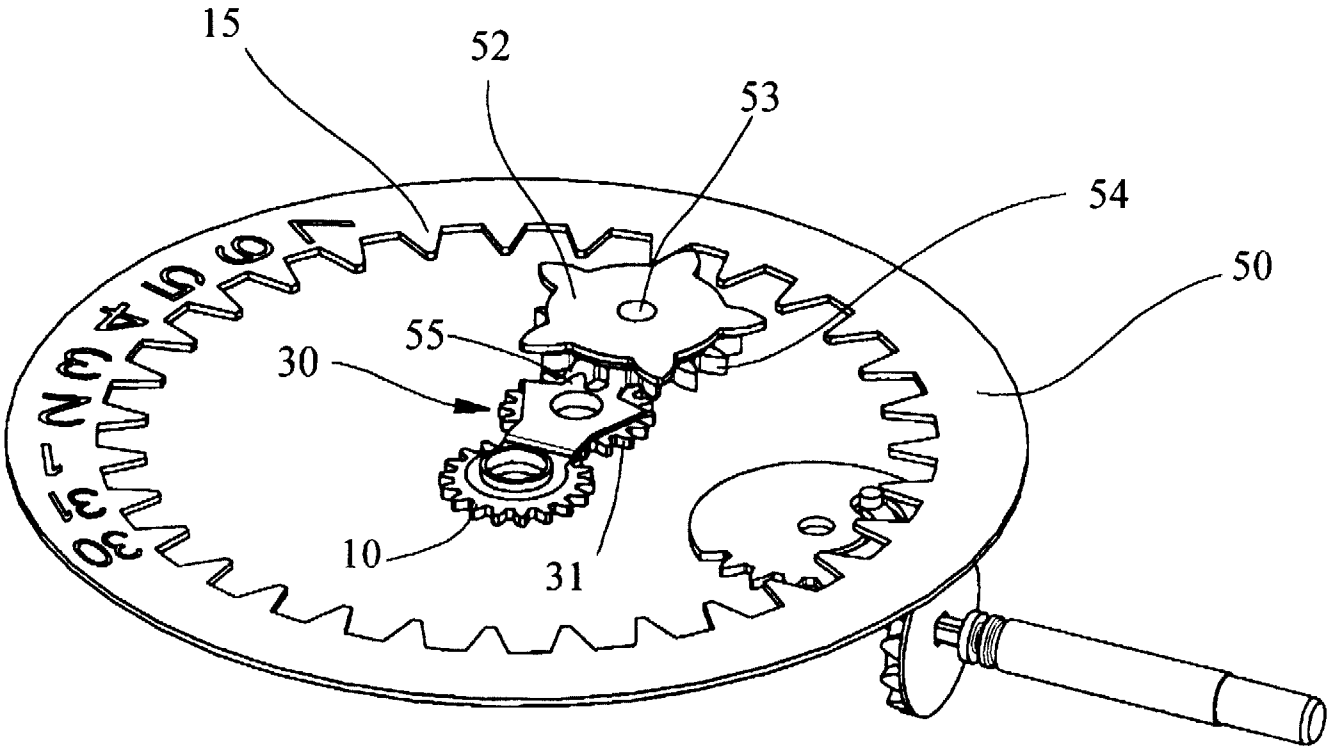
FIG. 6 is a perspective partial view, showing the date display device of the present invention.

Referring to FIG. 6, the date display mechanism of the present invention comprises an calendar ring or dial 50, which is divided into 31 sectors, each sector carrying the number of the corresponding day of the month. The calendar ring or dial 50 turns once a month, thus showing the number of the day of the month at a certain position.

The calendar ring or dial 50 is mounted concentrically with the hour wheel 10 on the main body 1. Its inner diameter is larger than the radius of the path of the planet gear device 30. Its inner perimeter is provided with a plurality of teeth 51.

The date display mechanism of the present invention further has a driving tooth wheel 52, which engages with the teeth 51. The driving tooth wheel 52 is mounted in a fixed position with an calendar driving wheel set 53 and drives the rotation of the calendar ring or dial 50. On its lower side a coaxial driven tooth wheel 54 is mounted. On the end of the planet carrier 31 which is farther from its rotational axis, a single tooth 55 is mounted.

The tooth 55 rotates along with the planet gear device 30. When it passes the driven tooth wheel 54, it pushes the driven tooth wheel 54 by a certain angle of rotation.

The tooth wheel 52 rotates along with the driven tooth wheel 54. Every time the tooth wheel 52 drives the calendar ring or dial by 1/31 of a full turn, the numbers indicating the date on the calendar ring or dial 50 proceed to the next position. Thus the calendar ring or dial 50 works as a display of the date.

The components of the present invention work together in a way that an alarm time cycle of 24 hours results, they are easily assembled, and a high timing precision is achieved. The time cycle of 24 hours allows for an easy addition of display functions, like day and night as well as date.

What is claimed is:

1. An alarm mechanism system, comprising:

an hour wheel;

a ring gear, concentrically surrounding said hour wheel, said hour wheel being rotatable against said ring gear;

a planet gear device, engaging with said hour wheel and said ring gear, said planet gear device sharing a common axis with said hour wheel and rotating around said common axis, as driven by said hour wheel, where the rotational velocity of said planet gear device is ½ of the rotational velocity of said hour wheel;

an alarm device, contacting said planet gear device at the moment, when said planet gear device reaches a predefined angular position, thus triggering an alarm; and an adjustment device, adjusting said predefined angular position and thereby adjusting the time at which said alarm device triggers said alarm;

wherein said planet gear device completes a full turn in 24 hours, such that said alarm is triggered once within 24 hours.

2. An alarm mechanism system according to claim 1, wherein said planet gear device comprises:

a planet carrier, rotating around said common axis, said planet carrier having an outer end with maximum distance to said common axis;

a first planet gear, which is rotatably mounted on said planet carrier close to said outer end, engaging with said ring gear; and a second planet gear, concentrically fixed to said first planet gear and engaging with said hour wheel.

3. An alarm mechanism system according to claim 2, wherein said alarm device comprises:

a alarm wheel, mounted rotatably, the axis of said alarm wheel coinciding with said common axis, the angular position of said alarm wheel varying as driven by said adjustment device; and an alarm trigger disc, attached to said alarm wheel and having a contact strip for contacting said planet gear carrier;

wherein said planet carrier, after having reached said predefined angular position, contacts said contact strip, such that an electric contact is established, and said alarm is triggered.

4. An alarm mechanism system according to claim 1, further comprising a date display device, said date display device in turn comprising:

a calendar ring or dial, mounted rotatably with an axis coinciding with said common axis and surrounding said hour wheel, the surface of said calendar ring or dial being marked by a plurality of number signs, the inner perimeter of said calendar ring or dial being provided with a plurality of teeth;

a driving tooth wheel, engaging with said teeth of said calendar ring or dial, driving said calendar ring or dial;

a driven tooth wheel, coaxially fixed to said driving tooth wheel; and a single tooth, mounted on said planet gear device, said single tooth with every turn of said planet gear device driving the rotation of said driven tooth wheel and said driving tooth wheel by a certain angle, such that said calendar ring or dial shifts to an angular position that indicates the following date.

* * * * *